US008490911B2

(12) United States Patent
Fast et al.

(10) Patent No.: US 8,490,911 B2
(45) Date of Patent: Jul. 23, 2013

(54) METHOD OF WINDING SHEETS WITH PREAPPLIED SEAM TAPE

(75) Inventors: Norman Douglass Fast, Littleton, CO (US); Walter Alexander Johnson, Centennial, CO (US)

(73) Assignee: Johns Manville, Denver, CO (US)

( * ) Notice: Subject to any disclaimer, the term of this patent is extended or adjusted under 35 U.S.C. 154(b) by 1333 days.

(21) Appl. No.: 11/899,261

(22) Filed: Sep. 5, 2007

(65) Prior Publication Data

US 2009/0057474 A1 Mar. 5, 2009

(51) Int. Cl.
*B65H 18/08* (2006.01)

(52) U.S. Cl.
USPC ..... 242/530.2; 242/530; 242/159; 52/746.11; 52/748.1; 428/40.1

(58) Field of Classification Search
USPC ..... 242/160.4, 160.3, 160.1, 159, 444.2, 242/532.3, 530.1, 530.2, 918, 919; 206/323, 206/324, 449; 428/194, 40.1; 52/409, 746.1, 52/746.11, 748.1, 741.1, DIG. 16; 156/184, 156/71, 60; 53/430, 118; 493/297, 274, 269; 270/552.18, 52.17, 52.08
See application file for complete search history.

(56) References Cited

U.S. PATENT DOCUMENTS

| | | | | |
|---|---|---|---|---|
| 7,198,220 | B2 * | 4/2007 | Knowlton | 242/530.2 |
| 7,510,752 | B1 * | 3/2009 | Robertson | 428/40.1 |
| 2004/0154265 | A1 * | 8/2004 | Knowlton | 52/741.1 |

* cited by examiner

*Primary Examiner* — Sang Kim
*Assistant Examiner* — Juan Campos, Jr.
(74) *Attorney, Agent, or Firm* — Robert D. Touslee

(57) ABSTRACT

Provided is a method of rolling two single-ply membrane sheets having seam tape applied along one edge, for easy transport. The method comprises placing a first sheet on top of a second sheet, with the seam tape edge of each of said sheets being at the same end. The sheets are placed so that the seam tape of the first sheet does not overlay the seam tape of the other sheet. The two sheets can then be easily and quickly rolled for transport to a job site.

7 Claims, 1 Drawing Sheet

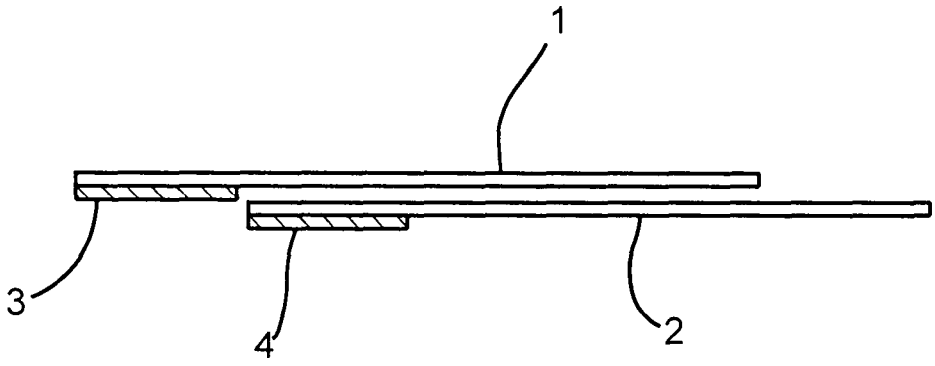
1
3
4
2

METHOD OF WINDING SHEETS WITH PREAPPLIED SEAM TAPE

BACKGROUND OF THE INVENTION

1. Field of the Invention

The present invention relates to a method of winding single-ply membrane sheeting with seam tape applied along one edge.

2. Description of the Related Art

Single-ply membrane sheeting incorporates a single-ply membrane as a water barrier for a roof surface. As it is impractical to manufacture sheeting wide enough to cover an entire roof, individual sheets are adhered together along lap seams to form a continuous water impervious sheet.

In the past the lap seams have been completely formed at the construction site. This requires that, when necessary, the overlapping edges be cleaned, a primer applied and then an adhesive. Adhesive seam tape is frequently used to form a lap seam. There are a variety of different seam tapes that can be applied and are readily available. These tapes are very tacky. Upon contact they adhere to the sheeting.

In order to reduce labor at the construction site, preapplication of the seam tape to the roofing membrane was thought to be desirable. Unfortunately, when one preapplies seam tape to the edge of a membrane, it interferes with storing and shipping the sheeting. Typically the sheeting is rolled onto a cylindrical core. Because ordinary sheeting has a uniform thickness, one can roll an indefinite length of material on the core. However, when a seam tape is applied to the edge of the sheeting, it cannot be simply rolled. The seam tape is generally almost as thick as the roofing membrane, and therefore, the sheeting cannot be simply rolled without a conical-shaped roll resulting. This interferes with shipping.

Different techniques have been proposed for overcoming these problems in rolling or winding membrane sheets with preapplied seam tape. For example, U.S. Pat. No. 7,198,220 discloses a method of winding two sheets with preapplied seam tape by placing one on top of the other. The seam tape of the first sheet is at one end and facing one direction whereas the seam tape of the adjoining sheet is at the opposite side and facing the opposite direction, either up or down. The two sheets are then rolled up together.

U.S. Pat. No. 7,044,411 discloses a method of winding membrane sheeting having a preapplied seam tape using filler strips. The filler strips are placed along the field portion of the membrane sheeting parallel to the seam tape. The sheeting is then rolled up to form a roll of membrane sheeting.

U.S. 2004/0187432A1 discloses rolling up membranes with preapplied seam tape by applying the seam tape along a first edge and folding a second edge of the membrane on itself so that it merely abuts an inner edge of the seam tape but does not overlap the seam tape. The concept is to form a folded sheet which has a uniform thickness across its entire width.

Nevertheless, the industry is still searching for unique methods of rolling or winding single-ply membrane sheeting having preapplied seam tape so that the task can be accomplished quickly and easily while also allowing the rolled sheeting to be easily shipped.

It is therefore an object of the present invention to provide a method of rolling or winding single-ply membrane sheeting with seam tape applied along one edge to permit easy shipping.

SUMMARY OF THE INVENTION

Accordingly, provided by the present invention is a method of rolling a first and second single-ply membrane sheet having seam tape applied along one edge comprising placing the first sheet on top of the second sheet with the seam tape edge of each of said sheets being at the same end. The sheets are placed such that the seam tape of the first sheet does not overlay the seam tape of the other sheet. The sheeting is then rolled, with the resulting rolled membrane sheets being easily transported.

BRIEF DESCRIPTION OF THE FIGURE OF THE DRAWING

In the FIGURE of the drawing, placement of the membrane sheets of the present invention is shown.

DETAILED DESCRIPTION OF THE PREFERRED EMBODIMENTS

In the process of the present invention, there is first provided two single-ply membranes, suitable as roofing membranes which have seam tape applied to one edge of the membrane sheet. The membrane sheets can be any type of sheeting typically used for roofing applications, such as EPDM, thermoplastic, elastomer, butyl rubber and PVC. Thermoplastic elastomer (TPO) sheeting is most preferred for the present invention. The sheeting is generally anywhere from 0.5 to 3.0 mm thick, and is generally from 1.0 to 1.5 mm thick. The seam type is generally thinner, but can approximate the thickness of the sheeting membrane. The seam tape can approach 1.0 mm in thickness, e.g., about 0.9 mm.

The seam tape may be any type of seam tape used in the roofing industry. It may be thermoplastic or thermosetting. Preferably, it is a pressure sensitive tape. There are several commercially available seam tapes that are used in the roofing industry, and any can be used. Although the width of the seam tape can vary depending on the type and application requirements, it will generally be about 3 inches wide.

In applying the seam tape in the factory, or at any off-site location, a primer layer is generally applied along a clean edge of the membrane. Subsequently, the seam tape is pressed against the membrane along the edge. The exposed surface of the seam tape is generally covered with a protective release sheeting. The application can be accomplished by placing the membrane onto a flat surface and manually apply the tape as described. The roofing membrane should be clean of any talc or dirt before applying the tape. In one embodiment, a double wide tape can be applied along the center line of the sheeting. The sheeting can then be cut along the center line to form two membrane sheets of equal width, each with seam tape on one edge.

Once the seam tape has been applied, a first sheet is placed on top of a second sheet as show in the FIGURE of the Drawing. The sheets 1 and 2 are placed such that the seam tape 3 and 4 of each of the sheets is at the same end, but with the first sheet having its seam tape 3 not overlay the seam tape 4 of the second sheet. The two membrane sheets can then be rolled in a standard manner, typically around a tube. The membrane sheets are capable of being rolled quickly and easily, and the rolled membrane sheets can be stacked and transported without any significant.

The rolls of sheeting are transported to a job site where the rolled membranes are unrolled and appropriately placed at the site with two sheets placed side by side with overlapping edges. The release sheet is then removed from the seam tape and the seam tape is pressed against the adjacent sheet at overlapped portions to form a lap seam.

While various embodiments have been described, it is to be understood that variations and modifications can be resorted to as will be apparent to those skilled in the art. Such variations and modifications are to be considered within the purview and scope of the claims appended hereto.

The invention claimed is:

1. A method of rolling a first and second single-ply membrane sheet having seam tape applied along one edge comprising placing the first sheet on top of the second sheet with the seam tape of each of said sheets being at the same end, and with the first sheet having its seam tape not overlay the seam tape of the other sheet, and then rolling the sheeting.

2. The method of claim 1, wherein the seam tape of the second sheet does not face the first sheet.

3. The method of claim 1, wherein said first and second sheets have the same width.

4. The method claim 1, wherein the seam tape thickness approximated the thickness of the membrane sheeting to which it is applied.

5. The method of claim 1, wherein the single-ply membrane sheeting is an EPDM, PVC, butyl rubber or thermoplastic elastomer membrane.

6. The method of claim 1, wherein at least one of the single-ply membrane sheets is a thermoplastic elastomer membrane.

7. The method of claim 5, wherein both of the membrane sheets are thermoplastic elastomer membranes.

* * * * *